US011814871B2

(12) United States Patent
Nicoara et al.

(10) Patent No.: US 11,814,871 B2
(45) Date of Patent: Nov. 14, 2023

(54) LOCKING PIN ASSEMBLIES AND USES THEREOF

(71) Applicant: Rav Bariach (08) Industries Ltd., Ashkelon (IL)

(72) Inventors: Peter Nicoara, Ashdod (IL); Eran Goldstein, Givatayim (IL)

(73) Assignee: Rav Bariach (08) Industries Ltd., Ashkelon (IL)

( * ) Notice: Subject to any disclaimer, the term of this patent is extended or adjusted under 35 U.S.C. 154(b) by 347 days.

(21) Appl. No.: 17/340,382

(22) Filed: Jun. 7, 2021

(65) Prior Publication Data

US 2022/0389739 A1 Dec. 8, 2022

(51) Int. Cl.

| | |
|---|---|
| ***E05B 27/10*** | (2006.01) |
| ***E05B 35/00*** | (2006.01) |
| ***E05B 19/00*** | (2006.01) |
| ***E05B 27/00*** | (2006.01) |

(52) U.S. Cl.

CPC ..... *E05B 27/10* (2021.08); *E05B 19/0058* (2013.01); *E05B 27/0017* (2013.01); *E05B 27/0021* (2013.01); *E05B 27/0042* (2013.01); *E05B 27/0071* (2013.01); *E05B 35/003* (2013.01)

(58) Field of Classification Search

CPC ..... E05B 19/0017; E05B 19/0052; E05B 19/0058; E05B 27/0017; E05B 27/0021; E05B 27/0039; E05B 27/0042; E05B 27/0071; E05B 27/10; E05B 35/00; E05B 35/003

See application file for complete search history.

(56) References Cited

U.S. PATENT DOCUMENTS

| | | | | |
|---|---|---|---|---|
| 5,520,035 | A * | 5/1996 | Eizen | E05B 27/0021 70/358 |
| 6,257,033 | B1 * | 7/2001 | Ziv-Av | E05B 27/0021 70/494 |
| 6,508,091 | B1 * | 1/2003 | Donatini | E05B 27/0021 70/378 |
| 8,336,350 | B2 * | 12/2012 | Nicoara | E05B 35/003 70/411 |
| 9,587,415 | B2 * | 3/2017 | Walls | E05B 27/0053 |
| 10,161,163 | B2 * | 12/2018 | Fustini | E05B 27/0021 |
| 10,287,799 | B2 * | 5/2019 | Nicoara | E05B 27/0021 |
| 11,505,965 | B2 * | 11/2022 | Matlock | E05B 27/0021 |
| 2003/0140668 | A1 * | 7/2003 | Chao | E05B 27/0021 70/359 |
| 2009/0293564 | A1 * | 12/2009 | Talamonti | E05B 27/0017 70/373 |
| 2013/0327102 | A1 * | 12/2013 | Ben-Aharon | E05B 35/003 70/493 |
| 2017/0081880 | A1 * | 3/2017 | Artsiely | E05B 35/003 |
| 2019/0010732 | A1 * | 1/2019 | Shen | E05B 27/0021 |

* cited by examiner

*Primary Examiner* — Christopher J Boswell

(74) *Attorney, Agent, or Firm* — The IP Law Firm of Guy Levi, LLC

(57) ABSTRACT

The disclosure relates to an improved cylinder lock, key and their combination. More specifically, the disclosure relates to a locking pin assembly operable to provide added combination and increase security against burglary, such as by key bumping, a cylinder lock incorporating the locking pin assembly and key blade and key blade assemblies having the configuration to actuate the locking pin assembly.

28 Claims, 10 Drawing Sheets

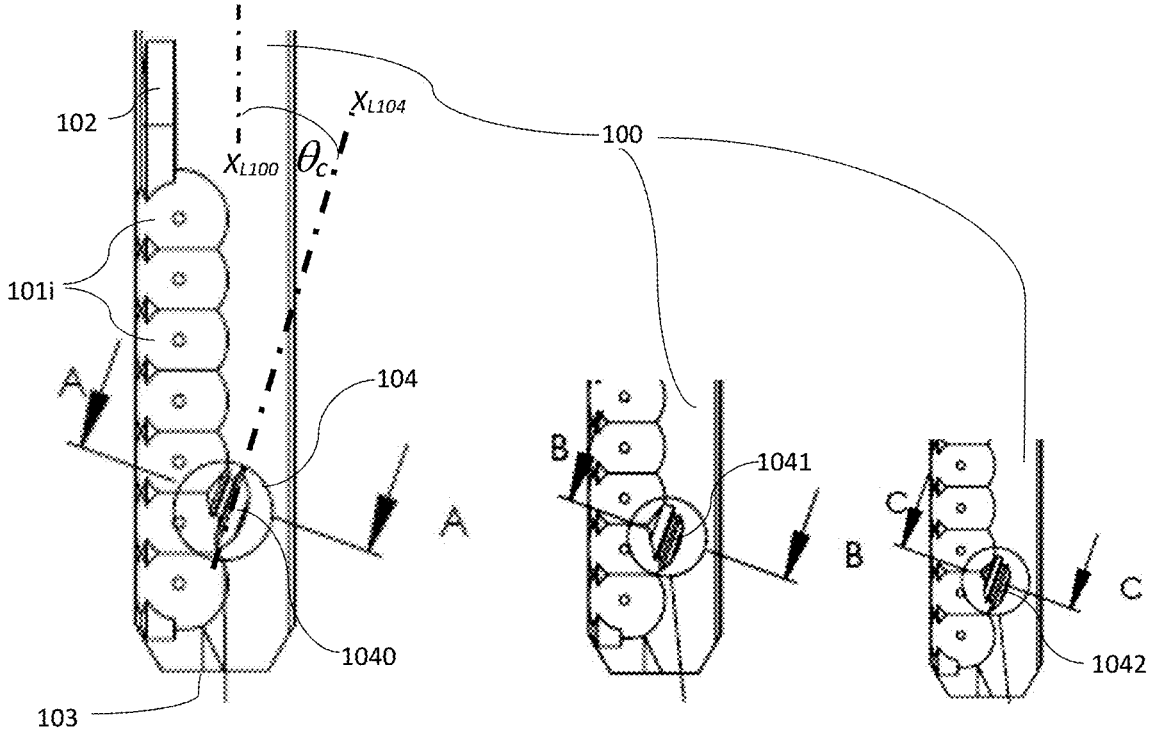
FIG. 1A FIG. 1B FIG. 1C
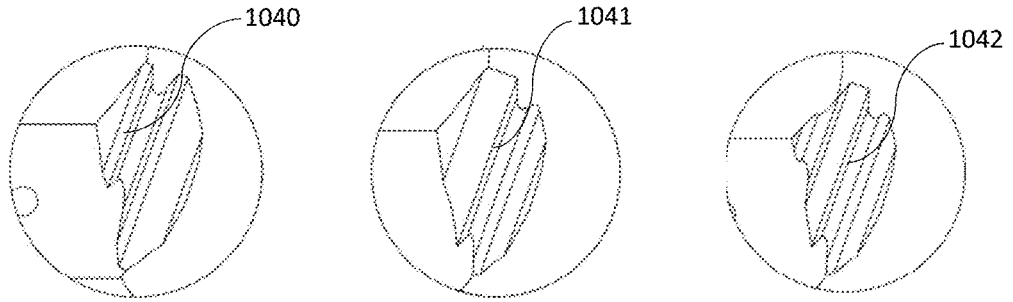
FIG. 2A FIG. 2B FIG> 2C
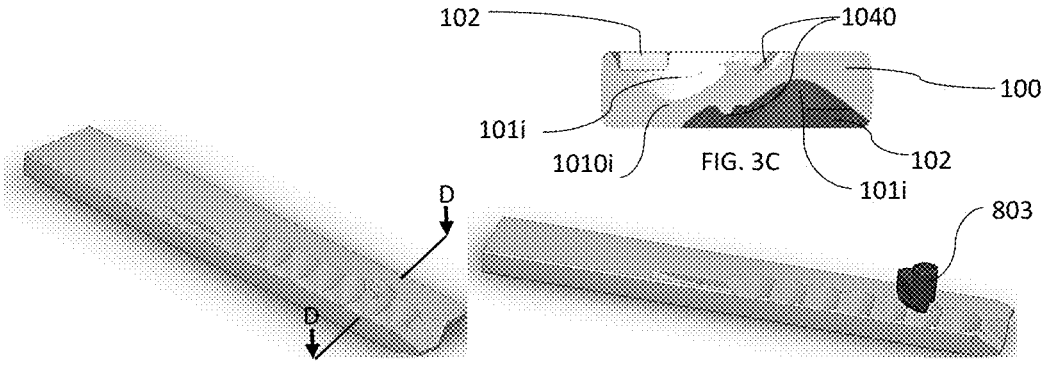
FIG. 3C
FIG. 3A FIG. 3B

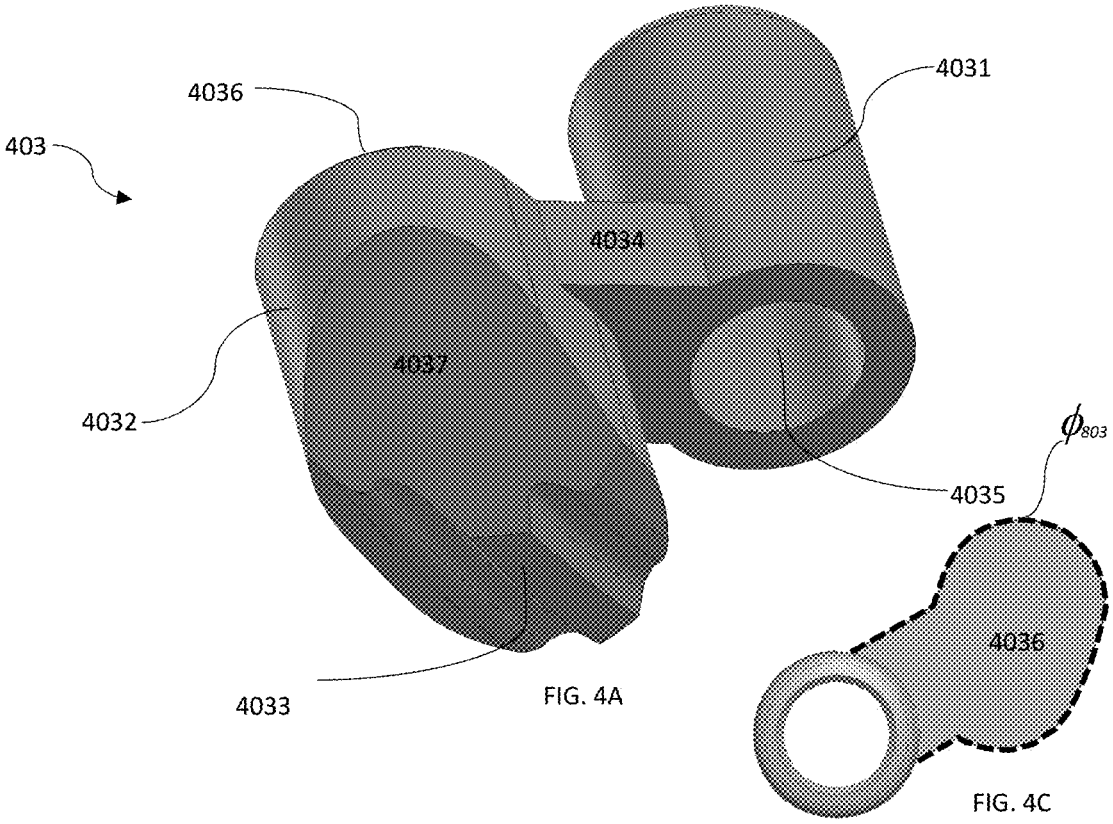
FIG. 4A
FIG. 4C
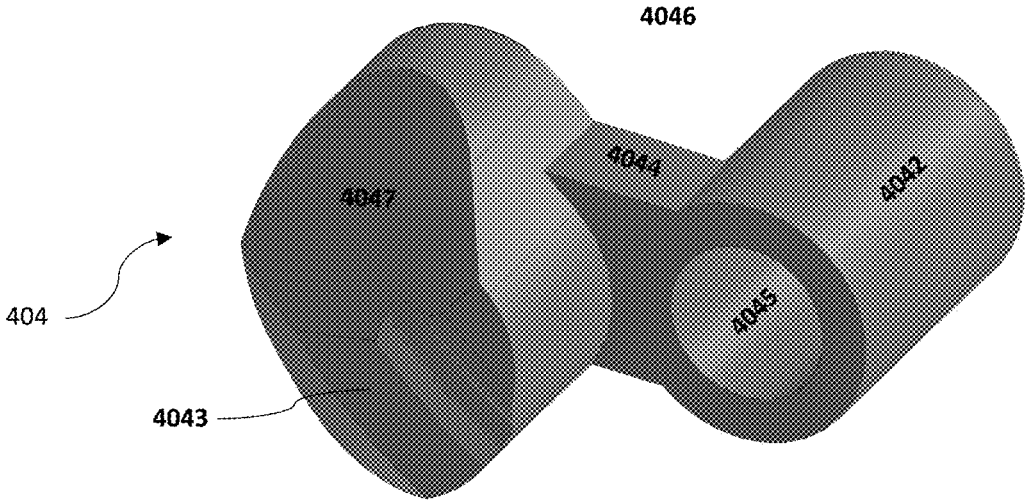
FIG. 4B

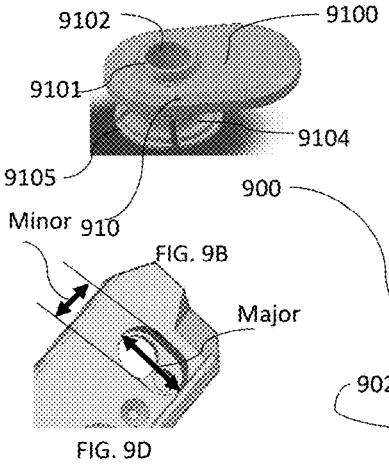
FIG. 9B
FIG. 9D
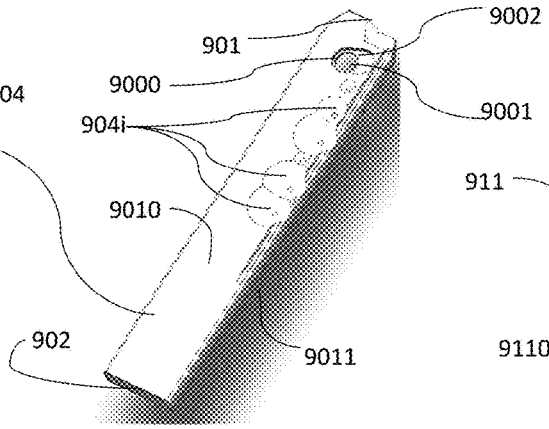
FIG. 9A
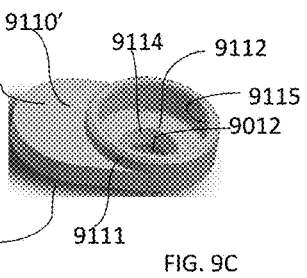
FIG. 9C
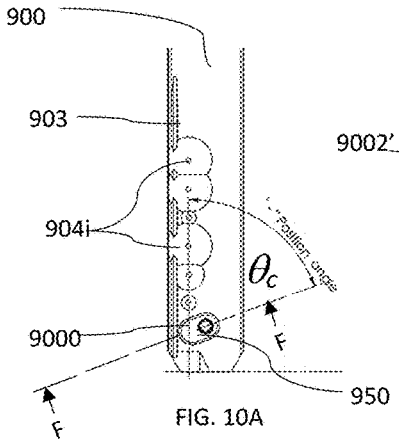
FIG. 10A
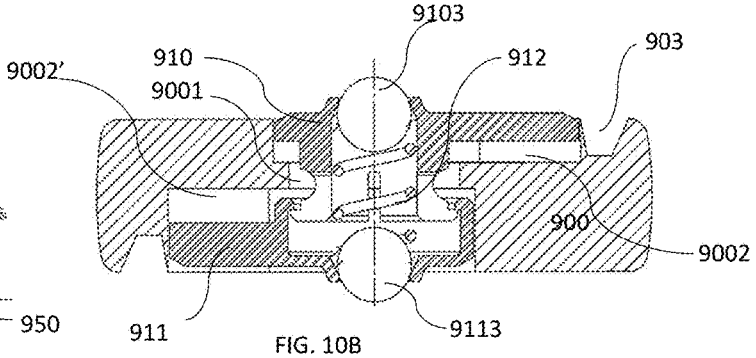
FIG. 10B
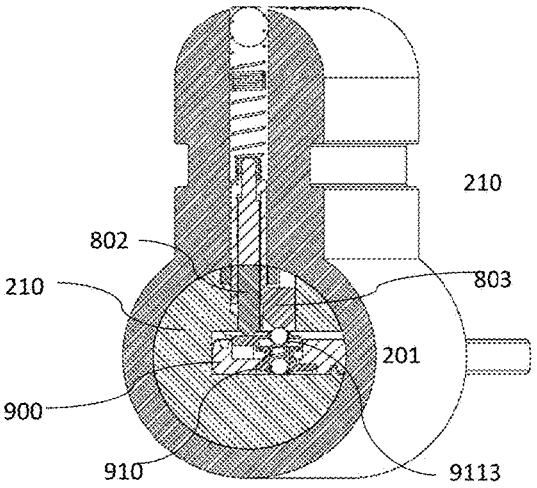
FIG. 10C

LOCKING PIN ASSEMBLIES AND USES THEREOF

BACKGROUND

The present disclosure is directed in general to an improved cylinder lock. More specifically, the disclosure is directed to a locking pin assembly operable to increase security against burglary, such as by key bumping.

Cylinder locks typically include a cylinder casing and a barrel rotatable in the casing. A plurality of barrel pins typically sit in the barrel and a plurality of pins are spring biased in registration therewith in the cylinder casing. When an appropriate key is inserted in the lock, the barrel pins are urged into height alignment inside the barrel and the casing pins are urged against the springs into a column portion extending radially from the casing, such that the shear line is not blocked (by any pin(s)) and the barrel can be turned inside the cylinder casing to lock or unlock the lock.

Locks to an entry must, in addition to allowing authorized individuals to enter, have specific key profiles that prevent unauthorized key duplication, either by an unauthorized entrant or an unauthorized professional assembling the duplicate key. Additionally, a variety of top-secret circumstances may require keys with more combinations that are difficult to duplicate in order to avoid unauthorized entry.

This key typically has flared punchings, or depressions, which, following insertion of the key in the lock's keyway, abut against control heads of pins housed in the lock. The depth and position of the punchings constitute the cuts of the key that corresponds to the position of barrel pins adapted to allow the rotation of the barrel. In fact, when the key corresponding to the lock is inserted into the keyway and the barrel pins abut in their respective punching, the opposite ends of the barrel pins align on the sliding surface between the barrel and cylindrical housing, allowing the rotation of the barrel itself.

One known method of opening this type of lock is called "key bumping", which consists in preparing a "bumping key" provided with punchings having the maximum depth obtainable in the thickness of the key itself. The bumping key can be inserted in the keyway of the lock at a length greater than the control key. In general, the bumping key is made starting from a blank or untreated key, adapted to create a duplicate of the control key of the lock, providing thereon maximum-depth punchings (depressions, e.g.), and filing the typical stop abutments of the control key. By inserting the bumping key in the keyway, all the barrel pins arrange at their maximum height. By hitting the key to push it further into the keyway, the pistons are subjected to an impact in a radial direction, making the rotation of the rotor possible.

The disclosure provided herein addresses these issues.

SUMMARY

Provided herein are exemplary implementations of an improved cylinder lock. More specifically, provided, are exemplary implementation of a locking pin assembly operable to increase security against burglary, such as by key bumping.

In an exemplary implementation, provided herein is a locking pin assembly comprising: a barrel pin assembly comprising a barrel pin having a predetermined length with an apical end and a distal end, the barrel pin defining a longitudinal axis; and an extender, having an apical end, slidably, coupled to the barrel pin, operable to slidably translate along the barrel pin in parallel with the barrel pin's longitudinal axis a column pin assembly comprising: a cylindrical sheath having an apical end, a basal end, an internal diameter and an external diameter; and a column pin having an apical end and a basal end, the column pin being nested in and concentric with the sheath, the column pin being slidably coupled to the cylindrical sheath; a stopper; and a biaser disposed beneath the stopper and coupled to the column pin, operable to bias the column pin and cylindrical sheath away from the stopper.

In another exemplary implementation, provided herein is a key comprising a key blade for use with the locking pin assemblies disclosed, defining at least one planar surface with a longitudinal axis, the key blade defining: at least one depression (e.g., flared punchings), operable to reversibly engage the basal end of the barrel pin; and an elongated engagement area abutting the at least one depression, the elongated engagement area defining a longitudinal axis and having a complementary surface to the predetermined surface topology of the engagement member of the extender forming a portion of the locking pin assembly.

In yet another exemplary implementation, provided herein is a cylinder lock comprising: a rotatable barrel defining an external, circumferential surface, having a proximal end and a distal end with an axial keyway and a plurality of barrel bores extending radially from, and in communication with the keyway, the barrel being selectably, rotatably movable within a cylindrical housing portion; the cylindrical housing portion having a column portion with a plurality of column bores, each column bore being in registration with a barrel bore, the each column bore extending radially from the cylindrical housing portion, wherein at least one column bore and at least one barrel bore in registration therewith, in combination, comprise, or contains the locking pin assemblies disclosed herein.

In an exemplary implementation, further provided herein is a method of preventing an unauthorized entry to an enclosed space having an opening with a door having a cylinder lock therein by key bumping, the cylinder lock configured to transition between a locked position preventing entry to the enclosed space, and an open position allowing entry to the enclosed space, the method comprises: providing a door wherein the cylinder lock comprises: a rotatable barrel defining an external surface, having a proximal end and a distal end with an axial keyway and a plurality of barrel bores extending radially from, and in communication with the keyway, the barrel being selectably, rotatably movable within a cylindrical housing portion; the cylindrical housing portion having a column portion with a plurality of column bores in registration with the plurality of column bores, extending radially from the cylindrical housing portion, wherein at least one column bore and barrel bore in registration therewith, both—in combination comprise a locking pin assembly, wherein the locking pin assembly comprises a barrel pin assembly disposed within the barrel bore, the barrel pin assembly comprising a barrel pin having a predetermined length with an apical end and a distal end, the barrel pin defining a longitudinal axis; and an extender, having an apical end, slidably, coupled to the barrel pin, operable to slidably translate along the barrel pin in parallel with the barrel pin's longitudinal axis; a column pin assembly disposed within the column bore, the column pin assembly comprising: a cylindrical sheath having an apical end, a basal end, an internal diameter and an external diameter; and a column pin having an apical end and a basal end, the column pin being nested in and concentric with the cylindrical sheath, the column pin being slidably coupled to the cylindrical sheath; a stopper engaged within the column bore; and a biaser disposed in the column bore beneath the stopper and coupled to the column pin, operable to bias the column pin and cylindrical sheath away from the stopper toward the axial keyway.

In a further implementation, provided herein is a key assembly comprising: an elongated key blade, the elongated key blade being substantially flat and having a first surface and a symmetric second surface defining a longitudinal axis; an ovoid depression defined on the first surface with a major axis and a minor axis, having side walls and a floor, wherein the major axis of the ovoid depression extends from the center of the elongated key blade—transverse to the longitudinal axis of the elongated key blade; an through aperture, defined in the ovoid depression spanning the width of the elongated key blade, the through aperture having a diameter smaller than the minor axis of the ovoid depression and is bored in the center of the key blade, wherein the floor of the ovoid depression form a shelf extending radially to the aperture; an ovoid male cap accommodated in the depression comprising: an outer surface and an inner surface; a double flanged cylindrical fitting having an internal diameter extending inward from the inner surface, the fitting having a basal resilient interrupted flange, operable to frictionally engage a portion of an ovoid female base, wherein the; the ovoid female base accommodated in the depression comprising: an outer surface identical to the outer surface of the ovoid male cap, and an inner surface; a cylindrical well defined in the inner surface; an annulus extending inward on the periphery of the well, the annulus having an outer diameter sized to abut the minor axis of the ovoid depression, and be larger than the through aperture, the annulus defining an internal rim operable to engage the basal resilient interrupted flange of the ovoid male cap; and a first biasing element, disposed within the double flanged cylindrical fitting and abutting the inner surface at the cylindrical well of the ovoid female base and is operable to bias the ovoid male cap from the ovoid female base, wherein the outer surface of the ovoid male cap defines at least two different topologies.

BRIEF DESCRIPTION OF THE DRAWINGS

For a better understanding of the locking pin assembly described herein and their use in a cylinder lock, with regard to the exemplary implementations thereof, reference is made to the accompanying drawings, in which like numerals designate corresponding elements or sections throughout and in which:

FIGS. 1A-1C, illustrates key blades comprising the depression and engagement elongated areas;

FIGS. 2A-C, shows an enlarged illustration of FIGS. 1A-1C, illustrating possible implementations to the engagement members' engagement topology;

FIG. 3A, illustrates an isometric view of a key blank with the depression and engagement are corresponding to FIG. 2A, with FIG. 3B illustrating an isometric view of the engagement member position on the engagement area of the key blade, and FIG. 3C, illustrating a Y-Z cross section of the key blade along line D-D of FIG. 3A;

FIGS. 4A and 4B, illustrate exemplary implementations of the extender with different engagement topology, with FIG. 4C illustrating predetermined perimeter shape of the linker and the engagement member;

FIG. 9A-9C illustrate an exemplary implementation of the key assemblies disclosed, with FIG. 9D clarifying major and minor axes of an ovoid;

FIG. 10A is a schematic illustrating the assembled exemplary implementation of FIGS. 9A-9C, while FIG. 10B showing a cross section along line F-F in FIG. 10A, with FIG. 10C, illustrating the key assembly illustrated in FIG. 10A, inserted within the cylinder lock implementations disclosed;

FIG. 11A is a schematic illustrating the assembled exemplary implementation, while FIG. 11B showing a cross section along line C-C in FIG. 11A, with FIG. 11C, illustrating the key assembly illustrated in FIG. 10A, inserted within the cylinder lock implementations disclosed;

DETAILED DESCRIPTION

Figure 5:
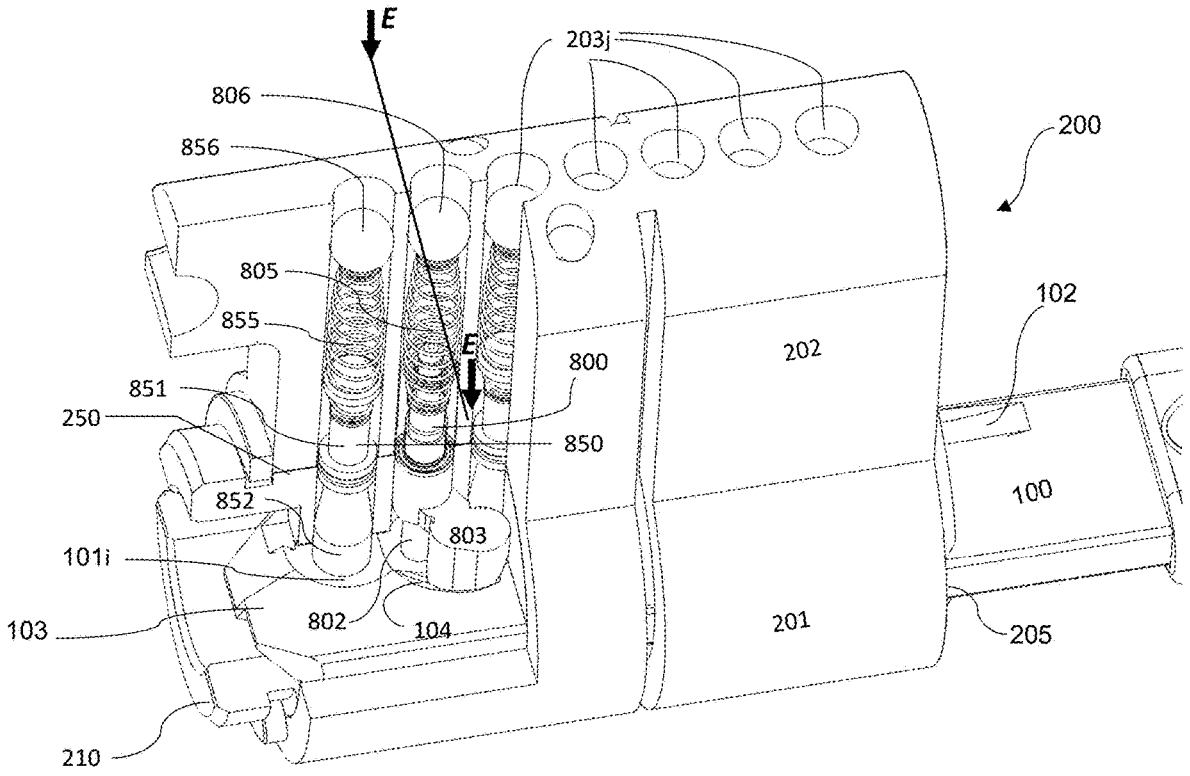
FIG. 5 is a cutaway view of the locking pin assembly in a cylinder lock with an authorized key blade fully inserted.

Provided herein are exemplary implementations of a locking pin assembly described herein and their use in a cylinder lock, and in methods for preventing, or inhibiting unauthorized opening using key bumping.

The term "coupled", including its various forms such as "operably coupling", "coupling" or "couplable", refers to and comprises any direct or indirect, structural coupling, connection or attachment, or adaptation or capability for such a direct or indirect structural or operational coupling, connection or attachment, including integrally formed components and components which are coupled via or through another component or by the forming process. Indirect coupling may involve coupling through an intermediary member or adhesive, or abutting and otherwise resting against, whether frictionally or by separate means without any physical connection.

In addition, the term "slidably" or "slidably coupled" refers to movement of one surface (for example the latching assembly) over a second surface (for example, the housing) while maintaining smooth continuous contact between the two surfaces. In another exemplary implementation, the term "slidably coupled" means a state in which two or more components are coupled to one another such that at least one of the components (e.g., the nested column pin assembly) at least slides with respect to another component (e.g., column bores). Likewise; the terms "slide," "slid" or "sliding" are defined as moving, gliding or passing along or through a surface, although continuous contact at each point along the path is not necessarily required.

The term "engage" and various forms thereof, when used, refer to the application of any forces that tend to hold the engaged components together against inadvertent or undesired separating forces (e.g., such as may be introduced during use of the lock). It is to be understood, however, that engagement does not in all cases require an interlocking connection that is maintained against every conceivable type or magnitude of separating force.

The term "abut", or "abuts" should not be understood to strictly mean that the respective parts must be touching. Rather, "abuts" means that any remaining space between an abutting portion will not cancel or nullify the intended operation of the abutting components.

In the context of the disclosure, the term "operable" means the system and/or the device and/or the program, or a certain element or step is fully functional, sized, adapted and calibrated, comprises elements for, and meets applicable operability requirements to perform a recited function when activated, coupled, implemented, actuated, effected, or implemented.

In the context of the disclosure, "biaser", interchangeable with "biasing element" means any device that provides a biasing force. Representative biasing elements include but are not limited to springs (e.g., elastomeric or metal springs, torsion springs, coil springs, leaf springs, tension springs, compression springs, extension springs, spiral springs, volute springs, flat springs, and the like), detents (e.g., spring-loaded detent balls, cones, wedges, cylinders, and the like), pneumatic devices, hydraulic devices, magnets, and the like, and combinations thereof. Likewise, "biasing member" as used herein refers to one or more members that applies an urging force between two elements.

In addition, for the purposes of the present disclosure, directional or positional terms such as "top", "bottom", "basal", "upper," "apical", "lower," "side," "front," "frontal," "forward," "rear," "rearward," "back," "trailing," "above," "below," "left," "right," "radial," "vertical," "upward," "downward," "outer," "inner," "exterior," "interior," "intermediate," etc., are merely used for convenience in describing the various implementations of the present disclosure.

In the context of the disclosure, the term "accommodate" refers to the ability of an accommodating element (e.g., cylindrical hinging member 8031) to allow passage or retention of another element (e.g., barrel pin 802) at close tolerance, without substantial space for other elements or components. Furthermore, as used herein, the term "accommodate" need only mean that at least a portion of something is inside the interior space of the accommodating element (e.g., cylindrical hinging member 8031), and there is not necessarily a requirement for all portions (e.g., of barrel pin 802, or column pin 801) to be inside the interior space of the accommodating element.

A more complete understanding of the components, and devices disclosed herein can be obtained by reference to the accompanying drawings. These figures (also referred to herein as "FIG.") are merely schematic representations based on convenience and the ease of demonstrating the present disclosure, and are, therefore, not intended to indicate relative size and dimensions of the devices or components thereof, their relative size relationship and/or to define or limit the scope of the exemplary implementations. Although specific terms are used in the following description for the sake of clarity, these terms are intended to refer only to the particular structure of the exemplary implementations selected for illustration in the drawings, and are not intended to define or limit the scope of the disclosure. In the drawings and the following description below, it is to be understood that like numeric designations refer to components of like function. Likewise, cross sections are referred to on normal orthogonal coordinate system having XYZ axis, such that Y axis refers to front-to-back, X axis refers to side-to-side, and Z axis refers to up-and-down.

Figures 8A, 8B:
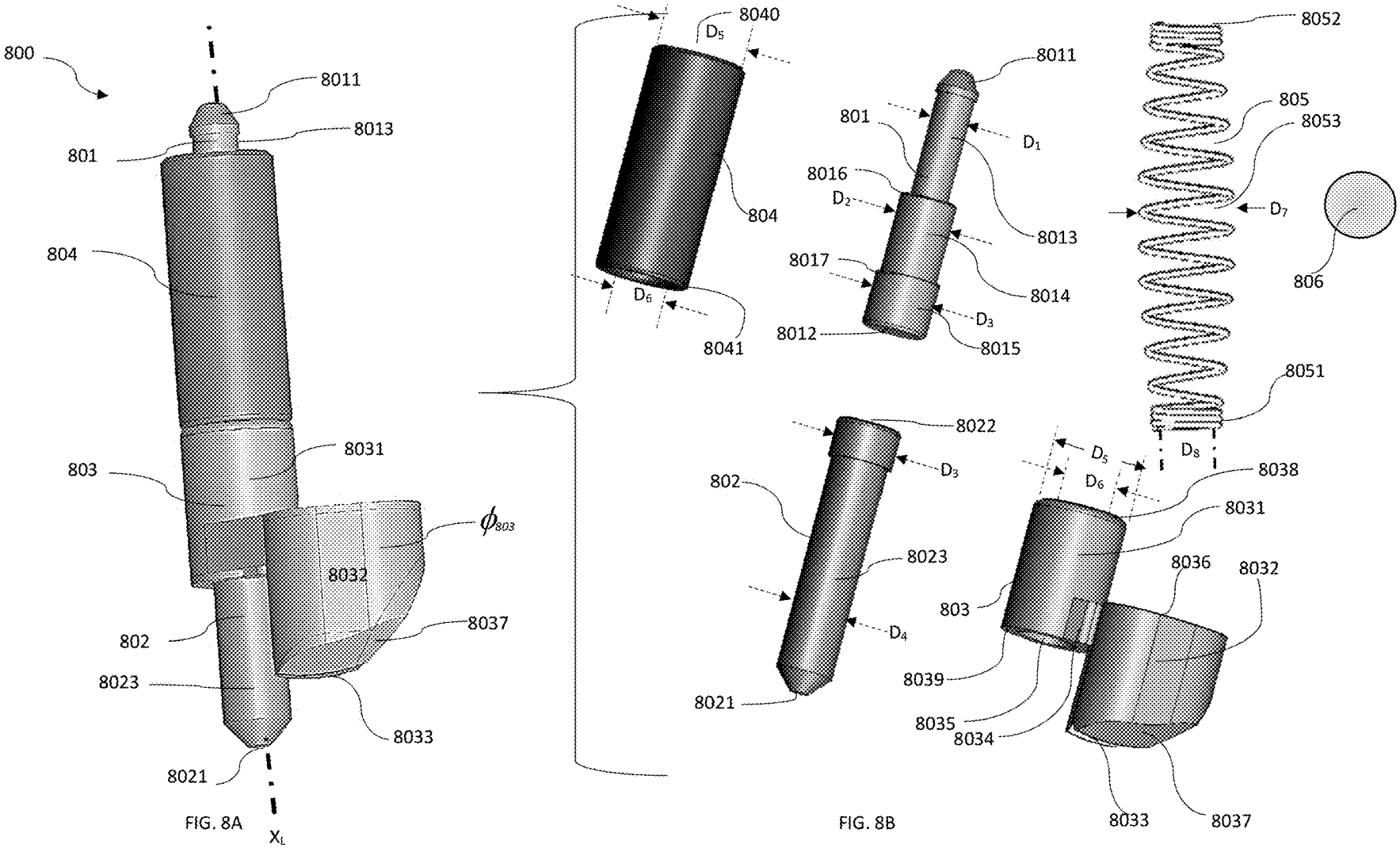
FIG. 8A is an isometric view of the assembled locking pin, with FIG. 8B, illustrating an exploded view thereof, including a biaser and a stopper.

Turning now to FIGS. 8A-8B, illustrating an exemplary implementation of locking pin assembly 800 comprising: a barrel pin assembly comprising barrel pin 802 having a predetermined length with apical end 8022 and basal end 8021, barrel pin 802 defining a longitudinal axis $X_L$; and an extender 803, having an apical endylindrical 8038, the extender 803 slidably, coupled to barrel pin 802 (in other words, barrel pin 802 acts as a pole on which extender 803 independently moves up and down), operable to slidably translate along barrel pin 802 in parallel with barrel pin's 802 longitudinal axis $X_L$. Locking pin assembly 800 further comprises a column pin assembly comprising: cylindrical sheath 804 having apical end 8040, basal end 8041, an internal diameter $D_6$ and external diameter $D_5$; and, column pin 801 having apical end 8011 and basal end 8012, column pin 801 being nested in, and concentric with cylindrical sheath 804, Further as indicated, column pin 801 is adapted sized and configured for being slidably coupled to cylindrical sheath 804. Furthermore, locking pin assembly 800 further comprises stopper 806; and biaser 805 disposed beneath stopper 806 and coupled to column pin 801, operable to bias column pin 801 and away from stopper 806.

As further illustrated in FIGS. 8A, 8B (as well as, in other exemplary implementations, FIGS. 4A, 4B) extender 803 is comprised of: cylindrical hinging member 8031 having an apical end 8038 (which is the apical end of extender 803), basal end 8033 (which is also the basal end of extender 803, cylindrical hinging member 8031 defining external diameter $D_5$ and internal diameter $D_6$, internal diameter $D_6$ configured to accommodate barrel pin 802, wherein cylindrical hinging member 8031 is being adapted, sized and configured to cover a portion of barrel pin 802 that is shorter than the length of barrel pin 802 (see e.g., FIG. 8A). Extender 803 further comprises linker 8034, radially coupled to cylindrical hinging member 8031 at cylindrical hinging member's 8031 basal end 8039 of cylindrical hinging member 8031; and engagement member 8032, having apical end 8036 and beveled 8037 defining a bevel having predetermined angle relative to cylindrical hinging member 8031 with basal end 8033, wherein beveled 8037 basal end 8033 defines a predetermined surface topology, wherein linker 8034 and engagement member 8032 define predetermined perimeter shape $\phi_{803}$ (see e.g., FIG. 4C).

In addition, column pin 801 is a cylindrical rod, defining top portion 8013 having first diameter $D_1$ and length, mid-portion 8014 having second diameter $D_2$ and length and basal portion 8015 having third diameter $D_3$ and length. Likewise, biaser, or biasing element 805 is likewise a dual frustoconical (base-to-base) cylindrical (e.g., compression) spring having apical end 8052 and basal end 8051, both defining end diameter $D_8$, with mid-portion 8053 defining mid-diameter $D_7$; the end diameter $D_8$ of biaser 805 (compression e.g.,) spring being larger than first diameter $D_1$ of top portion 8013 of column pin 801 and smaller than second diameter $D_2$; and wherein internal diameter $D_6$ of cylindrical sheath 804 is larger than mid-portion 8053 diameter $D_7$ of the biasing element 805 (compression e.g.,) spring.

Moving on to barrel pin 802, which, in an exemplary implementation is a cylindrical rod and wherein flanged apical end 8022 defines diameter $D_3$ that is identical to third diameter $D_3$ of basal portion 8015 of column pin 801, and wherein the external $D_5$ and internal diameter $D_6$ of cylindrical sheath 804 are each identical to the respective external and internal diameters $D_5$, $D_6$, of cylindrical hinging member 8031 of extender 803.

Accordingly, and in another exemplary implementation, locking pin assembly 800, is operable to transition between: a configuration, whereby when incorporated in a cylindrical lock will allow the barrel to freely rotate within the cylindrical housing (e.g., drum) and allow opening of the lock, whereby basal end 8012 of column pin 801, nested within cylindrical sheath 804 (configured to telescopically move therein) and while being coplanar (in other words, substantially all points on both elements portions exist on a single geometric continuous plane) with basal end 8041 thereof, are abutting apical end 8022 of barrel pin 802 nested (and configured to telescopically move therein) within cylindrical hinging member 8031 and being coplanar with apical end 8038 thereof. Conversely in a locking configuration, at least one of: basal end 8012 of column pin 801, basal end 8041 of cylindrical sheath 804, apical end 8022 of barrel pin 802, and apical end 8038 of cylindrical hinging member 8031—are not coplanar.

As indicated, typically key has flared punchings, or depressions, which, following insertion of the key in the lock's keyway (see e.g., FIGS. 5-6C), abut against basal ends of barrel pins housed in the lock. The depth and position of the punchings or depressions, constitute the typical cuts of the key that corresponds to the position of basal ends of the barrel pins adapted to allow the rotation of the barrel assuming a single coplanar shear plane is formed across all pins, such that when the barrel pins abut in their respective punching, the opposite ends of the barrel pins align on the sliding surface of the barrel (see e.g, FIG. 6B) between barrel 210 and cylindrical housing 200, allowing rotation of barrel 210 itself. Accordingly and in another exemplary implementation as illustrated in FIGS. 1A-4B and 8B, disclosed is key comprising key blade 100 for use with locking pin assembly 800 disclosed herein, defining at least one planar surface with longitudinal axis $X_{L100}$, key blade 100 defining: at least one depression 101*i*, operable to reversibly engage basal end 8021 of barrel pin 802; and an elongated engagement area 104 abutting at least one $i^{th}$ depression 101*i*, elongated engagement area 104 defining a longitudinal axis $X_{L104}$ and having a complementary surface 1040, 1041, 1042 (see e.g., FIGS. 2A-2C) to predetermined surface topology (see e.g., FIG. 4A, 4B, 8B) of basal end 4033, 4043, 8033 engagement member 4031, 4041, 8031 of extender 403, 404, and 803 respectively. In the context of the disclosure, and as illustrated in FIGS. 2A-2C, the term "complimentary" means that engagement area 104 surface 1040, 1041, 1042 of key blade 100 forms the geometrically negative counterpart to the contact surface (e.g., engagement member 4031, 4041, 8031 of extender 403, 404, and 803 respectively). If the contact (key blade 100) surface is substantially planar, the bearing surface of the contact piece (e.g., engagement member 4031, 4041, 8031 of extender 403, 404, and 803 respectively) is also substantially planar. Similarly, with a convex contact surface, the bearing surface has a concave shape with corresponding dimensions. This configuration reliably ensures that there is a large-area mating contact between the contact surface and the bearing surface of the contact piece, increase the key combination and prevents, or inhibit key bumping as a break-in option. Furthermore, in the context of the disclosure, the term "topology" means a three-dimensional structure of a surface, wherein the characteristic dimension of the structure typically ranges between about 0.1 mm and about 5 mm. The topology may be palpable, e.g., as a texture, or it can be so fine that it is visible but cannot be sensed by touch.

As illustrated in FIGS. 1A-1C, longitudinal axis $X_{L100}$ defined by key blade 100 and longitudinal axis $X_{L104}$, defined by elongated engagement area 104 form a predefined angle $\theta_c$, where, in another exemplary implementation, the predetermined angle is between about 15° and 180°, or between about 30° C. and about 75°, for example, between 30° and 60°, or, in another exemplary implementation, the predetermined angle is bet ween about 105° and 165°, or between about 120° C. and about 165°, for example, between 120° and 150°. Further, and as illustrated for example, in FIG. 3C, at least on $i^{th}$ depression 101*i* is concave and wherein the lowest, or deepest point 1010*i* in the $i^{th}$ depression 101*i* is convex (or, in other words, raised) with a surface that is complimentary to the surface of basal end 8021 of barrel pin 802.

In certain exemplary implementations, locking pin assembly 800, and key blade 100, are sized adapted and configured to operate a cylinder lock. Accordingly, provided and illustrated in FIGS. 5-7, is cylinder lock 200 comprising (see e.g., FIG. 7): rotatable barrel 210 defining external surface 211 forming the shear plane between the column pin assembly and the barrel pin assembly, having proximal end 212 and distal end 213 with axial keyway 205 and plurality of barrel bores 215*k* extending radially from, and in communication with axial keyway 205, barrel 210 being selectably, rotatably movable within cylindrical housing portion 201 (see e.g., FIG. 5, 6A, 6B); cylindrical housing portion 201 having column portion 202 with plurality of column bores 203*j* in registration with plurality of barrel bores 215*k*, extending radially from cylindrical housing portion 201, wherein at least one $j^{th}$ column bore 203*j* and at least one $k^{th}$ barrel bore 215*k* in registration with that $j^{th}$ column bore 203*j*, in combination, is adapted, sized and configured to comprise, or engage, and accommodate locking pin assembly 800.

Figure 6A:
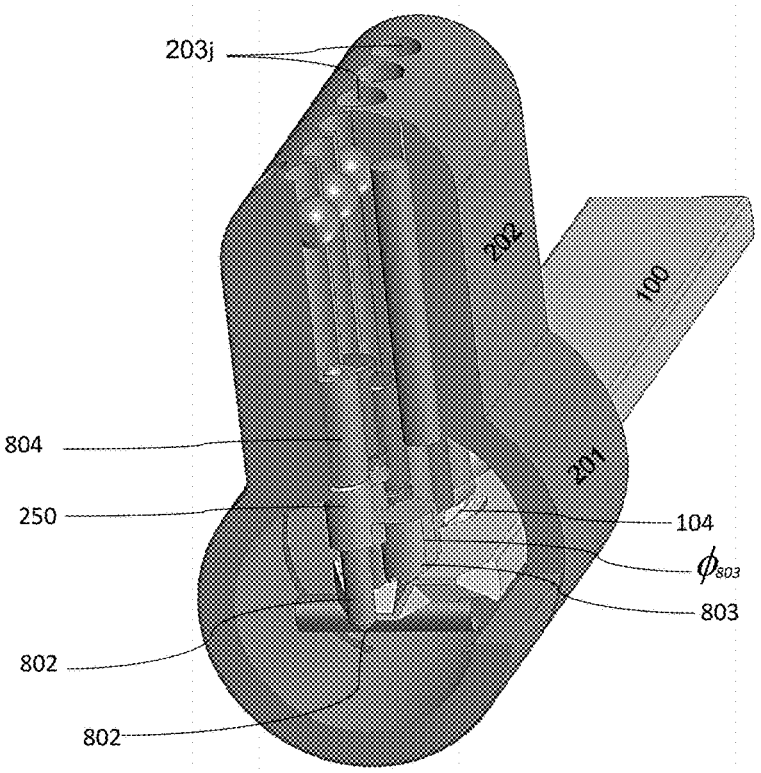
FIG. 6A is a cutaway view of a Y-Z cross section of the locking pin assembly in a cylinder lock with an authorized key blade not fully inserted, with FIG. 6B, illustrating a cutaway view of a Y-Z cross section of the locking pin assembly in a cylinder lock with an authorized key blade fully inserted both along line E-E of FIG. 5, and FIG. 6C being a schematic of FIG. 6B drawn along line F-F in FIG. 6B.
Figure 6B:
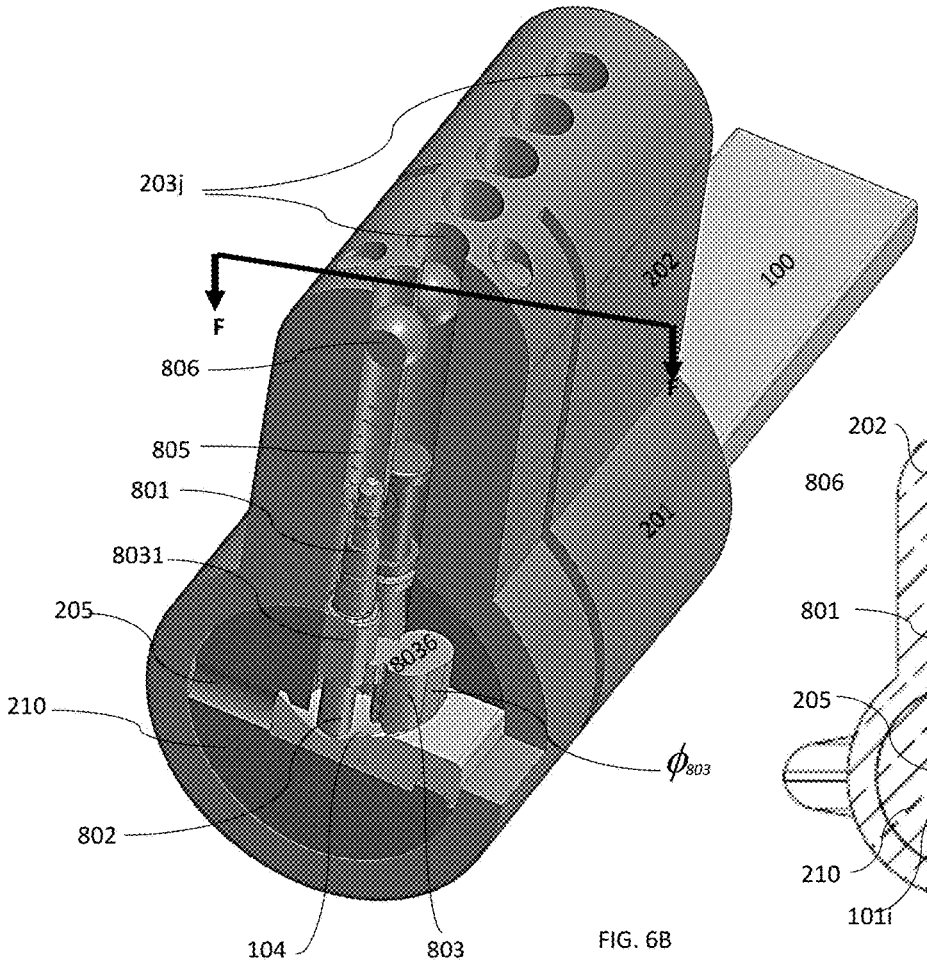
Figure 6C:
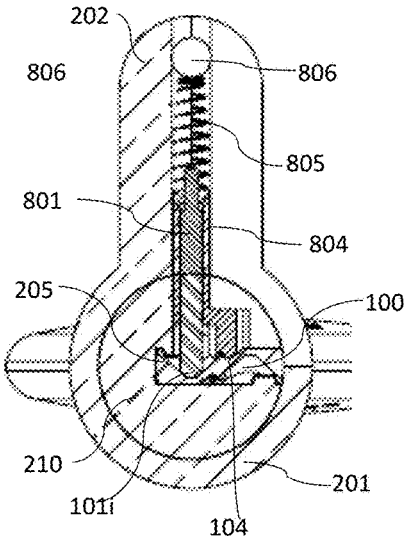
Figure 7:
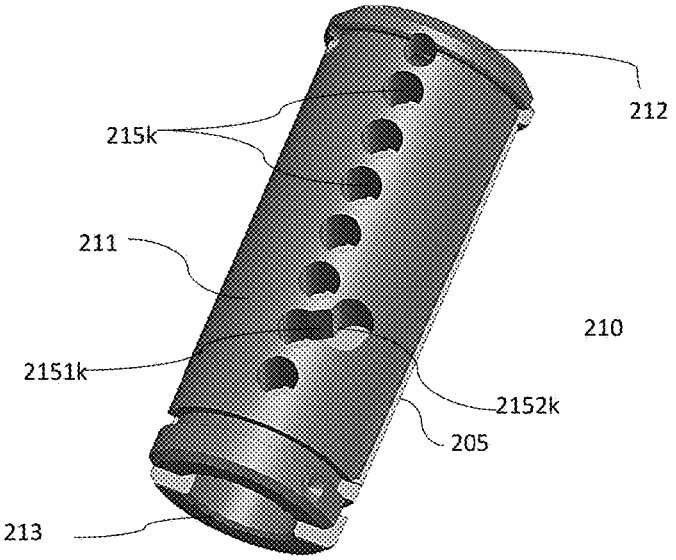
FIG. 7, is an isometric view of the barrel.

As illustrated e.g., in FIGS. 5, and 6C; one $j^{th}$ column bore 203*j* and at least one $k^{th}$ barrel bore 215*k* in registration with that $j^{th}$ column bore 203*j*, is configured such that: $j^{th}$ column bore 203*j* comprises the column pin assembly; and $k^{th}$ barrel bore 215*k* in registration with $j^{th}$ column bore 203*j*, comprises the barrel pin assembly. Accordingly, $j^{th}$ column bore 203*j* is adapted, sized and configured to accommodate stopper 806 (see e.g., FIGS. 5, 6C), biaser element 805, column pin 801, and cylindrical sheath 804, while $k^{th}$ barrel bore 215*k* in registration with $i^{th}$ column bore 203*j* accommodating the column pin assembly, is adapted sized and configured to accommodate barrel pin 802 and extender 803. As illustrated in FIG. 7, the registered $k^{th}$ barrel bore 215*k* further defines cavity 2151*k*, 2152*k* sized and configured to accommodate linker 4034, 4044, 8034 and engagement member 4031, 4041, 8031 of extender 403, 404, 803 respectively, sized and configured to allow cylindrical hinging member 4031, 4041, 8031 to slidably translate along barrel pin 802.

As further illustrated in FIG. 5, one $i^{th}$ column bore 203*j* and at least one $k^{th}$ barrel bore 215*k* in registration with that $i^{th}$ column bore 203*j*, is configured such that: $i^{th}$ column bore 203*j* is adapted to comprise an anti-bumping pin assembly 850 with mushroom sheath 852, having basal surface topology 8523 (see e.g., FIG. 15) that is at least partially complimentary (see e.g., elements 8526, 8527) complimentary to the topology of depression 101*i* (904*i*, FIG. 9A) corresponding to its location. As illustrated, mushroom sheath 852 having flanged 8521 apical end 8520, abuts corresponding column pin 851 biased by biaser 855 toward key blade 100. Anti-bumping pin assembly 850 can further comprise barrel locking pin 853 (not shown, see e,g, barrel pin 802), and is adapted to rotate freely about barrel pin 802. Further exemplary implementations of ant-bumping pin assemblies are discussed herein in conjunction with FIGS. 13-15 hereinbelow.

Turning now to FIGS. 9A-12B, referring to an alternative key assembly used in an exemplary implementation, with the locking pin assemblies disclosed. Accordingly, provided herein is key assembly 90 (see e.g., FIG. 9A), comprising: elongated key blade 900, elongated key blade 900 being substantially flat with a proximal end 901 and a distal end 902 having depression 904*i*, and having first surface 9010 and symmetric second surface 9011 defining longitudinal axis ($X_L$, see e.g., FIG. 1A); ovoid depression 9000 defined on first surface 9010 with major axis and minor axis, having side walls 9003 and floor 9002, wherein the major axis of ovoid depression 9000 extends from the center of elongated key blade 900—transverse to longitudinal axis of elongated key blade 900; through aperture 9001, defined in ovoid depression 9000 spanning width (a through hole) of elongated key blade 900, through aperture 9001 having a diameter smaller than the minor axis of ovoid depression 9000 and is bored in center of key blade 900, wherein floor 9002 of ovoid depression 9000 form shelf extending radially to aperture 9001 (see e.g., FIG. 9D, 12A); ovoid male cap 910 accommodated in ovoid depression 9000 comprising: outer surface 9100 and inner surface 9100' (not shown); double flanged cylindrical fitting 9104 having internal diameter extending inward (in other words, into key blade 900 ovoid depression 9000) from inner surface 9100', fitting 9104 having basal resilient interrupted flange 9105, operable to frictionally engage portion of ovoid female base 911; ovoid female base 911 accommodated in ovoid depression 9000 on second surface 9011 comprising: outer surface 9110 identical to outer surface 9100 of ovoid male cap, and inner surface 9110'; cylindrical well 9112 defined in inner surface 9110'; annulus 9111 extending inward (in other words, into key blade 900 ovoid depression 9000 in second surface 9011) on periphery of cylindrical well 9112, annulus 9111 having outer diameter sized to abut the minor axis of ovoid depression 9000, and be larger than through aperture 9001, annulus 9111 defining internal rim 9115, operable to engage basal resilient interrupted flange 9105 of ovoid male cap 910; and first biasing element 912, disposed within double flanged cylindrical fitting 9104 and abutting inner surface 9110' at cylindrical well 9112 of ovoid female base 911 and is operable to bias ovoid male cap 910 from ovoid female base 911, wherein outer surface 9100 of ovoid male cap 910 defines at least two different topologies (with wherein outer surface 9110 of ovoid female base 911 defining the identical topology).

Figure 11A:
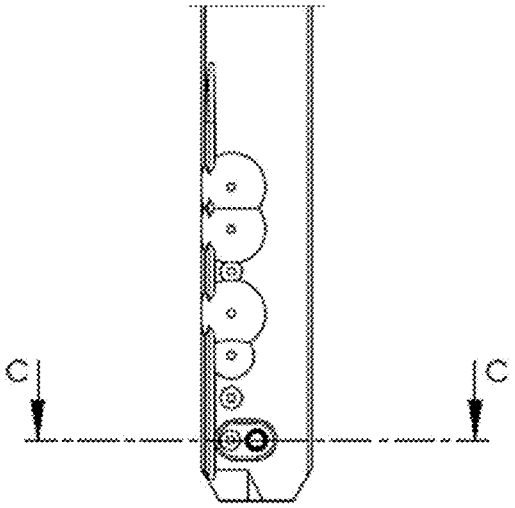
FIG. 11A-11C, illustrate additional implementations with different topologies, where
Figure 11B:
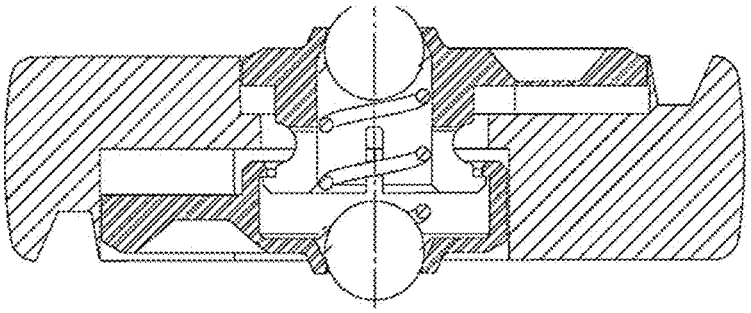

As illustrated, for example, in FIGS. 10A-10C, the major axis (see e.g., FIG. 10A) of ovoid depression 9000 extends from the center of elongated key blade 900—transverse to the longitudinal axis $X_L$ of elongated key blade 900 at a predetermined angle $\theta_c$ of between 0° and about 75° off normal (in other words, off perpendicular, see e.g., FIGS. 11A for 0 off normal, and 10A for a different position angle).

Figure 11C:
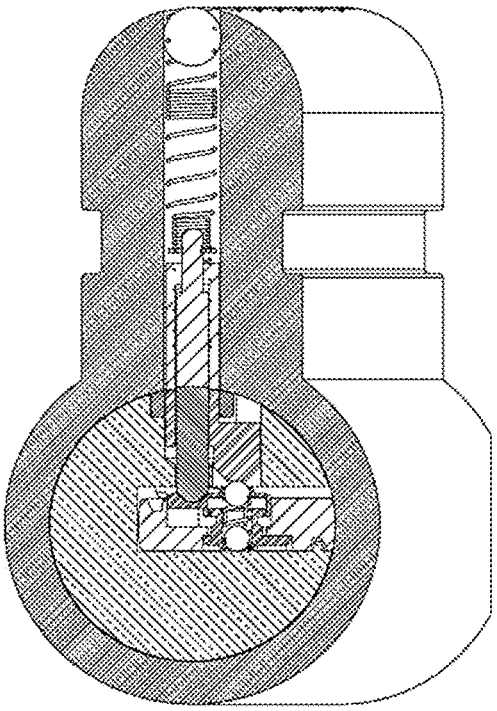

Furthermore, as illustrated in FIGS. 10C, and 11C and in exemplary implementation, outer surface 9100 of ovoid male cap 910 defines first and second topologies, whereby ovoid female base 911 defines matching topologies, first topology being coaxial with through aperture 9001 and second topology defined along major axis of ovoid depression 9000 at distance greater than the minor axis of ovoid depression 9000, wherein: the second topology is configured to engage barrel locking pin 802 having basal end 8021 (see e.g., FIG. 8B) with complimentary surface to second topology; and first topology, is configured to engage extender 803 operably coupled to barrel locking pin 802, wherein extender 803 comprises basal end 8037 with complimentary surface to first topology.

In another exemplary implementation, key assembly 90 further comprising; in ovoid male cap 910: first circular opening 9102 being coaxial with double flanged cylindrical fitting 9104; first ring 9101 disposed on outer surface 9100 of ovoid male cap 910, first ring 9101 being coaxial with first circular opening 9102 and having internal diameter smaller than internal diameter of double flanged cylindrical fitting 9104; and first ball bearing 9103, sized and configures to partially extend from outer surface 9100 outward from first ring 9101, first ball bearing 9103 being biased outward by first biasing element 912 (see e.g., FIG. 10B); and in ovoid female base 911: first circular opening 9012 being coaxial with and extending into cylindrical well 9112; first ring 9111 disposed on outer surface 9110 of ovoid female base 911, first ring 9111 being coaxial with first circular opening 9012 and having internal diameter smaller than second ball bearing 9113, said second ball bearing 9113 being identical to first ball bearing 9103; and; second ball bearing 9113, sized and configures to partially extend from outer surface 9110 of ovoid female base 911 outward from first ring 9111, second ball bearing 9113 being biased outward by first biasing element 912.

Figure 12A:
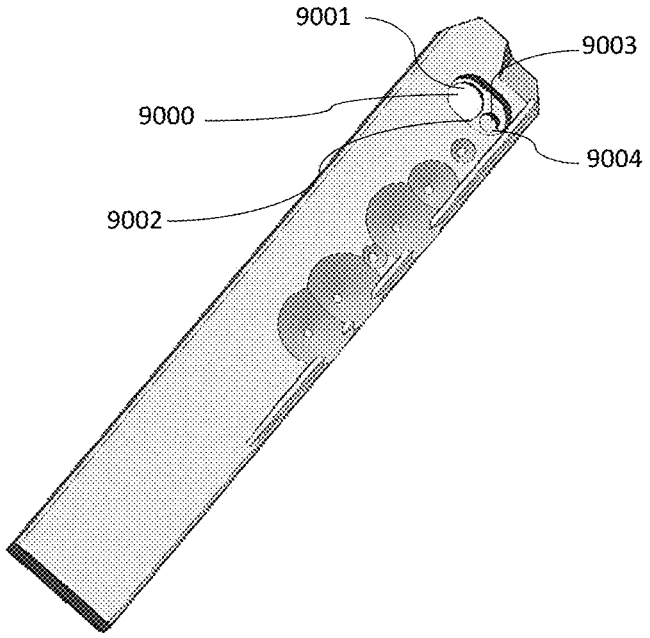
FIG. 12A-12B, are a schematic illustration of an exemplary implementation, having two ball bearings as part of the topology of the ovoid elements used in the key assembly.
Figure 12B:
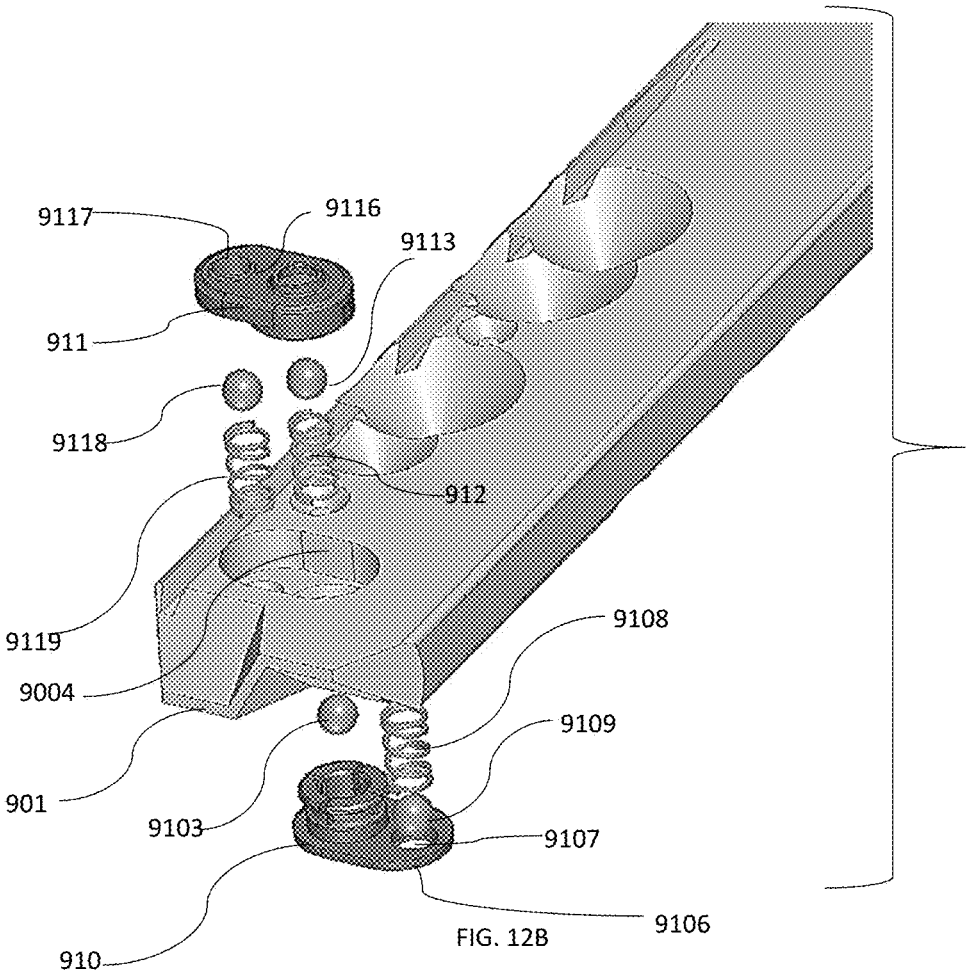

Additionally, or alternatively, in yet another exemplary implementation illustrated n FIGS. 12A-12B, key assembly 90 used in conjunction with locking pin assemblies, and cylinder locks disclosed, can further comprise: in ovoid male cap 910: second circular opening 9106 defined in outer surface 9100 along major axis of ovoid depression 9000 at distance greater than minor axis of ovoid depression 9000; second ring 9107, disposed on outer surface 9100 of ovoid male cap 910, second ring 9107 being coaxial with second circular opening 9106 and having internal diameter smaller than third ball bearing 9109; third ball bearing 9109, sized and configures to partially extend from outer surface 9100 of ovoid male cap 910 outward from second ring 9107, third ball bearing 9109 being biased outward by second biasing element 9108; and second biasing element 9108, disposed between shelf formed by floor 9002 of ovoid depression 9000 and third ball bearing 9109; and in ovoid female base 911: second circular opening 9117 defined in outer surface 9110 along major axis of ovoid depression 9110 on second surface 9011 at distance greater than minor axis of ovoid depression 9000; second ring disposed 9116 on outer surface 9110 of ovoid female base 911, second ring 9116 being coaxial with second circular opening 9117 and having internal diameter smaller than fourth ball bearing 9118; fourth ball bearing 9118, sized and configures to partially extend from outer surface 9110 of ovoid female base 911 outward from second ring 9116, fourth ball bearing 9118 being biased outward by third biasing element 9119; and third biasing element 9119, disposed between the shelf formed by the floor 9002 of the ovoid depression 9000 and the fourth ball bearing 9119.

Figure 13:
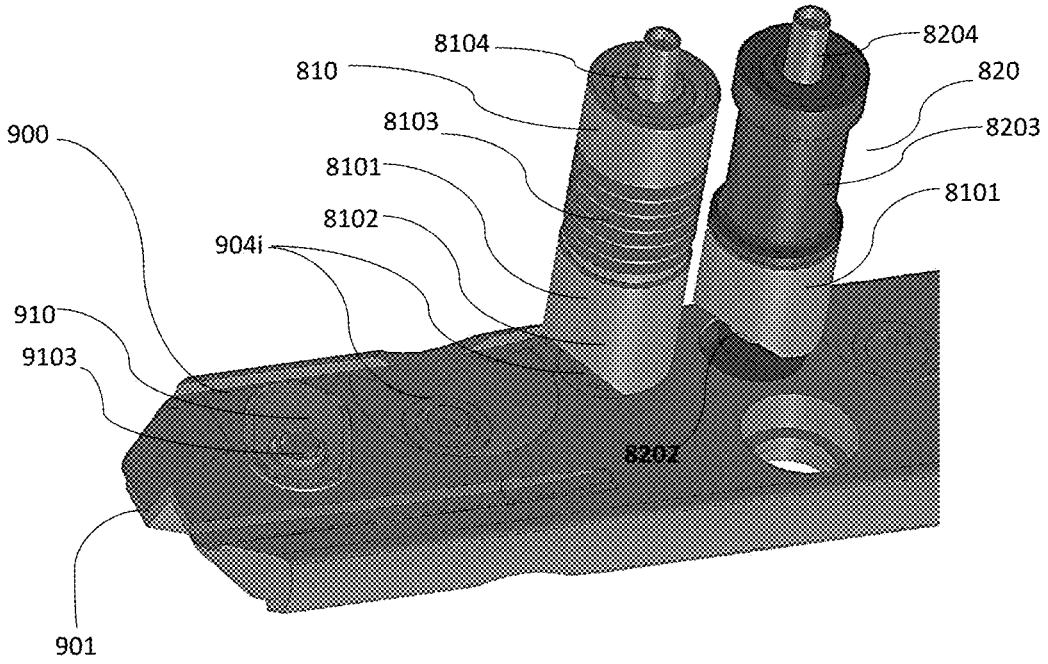
FIG. 13, illustrates a configuration for an exemplary implementation of anti-bumping barrel pin assemblies with the key blades disclosed.

Turning now to FIG. 13, illustrating configuration for an exemplary implementation of anti-bumping barrel pin assemblies with the key blades disclosed. As illustrated in FIG. 5, in addition to locking pin assembly 800, cylinder lock 200 can further comprise at least one anti-bumping pin assembly (see e.g., 850 FIG. 5, and/or 810, 820, FIG. 13). Generally, anti-bumping pin assemblies can have a substantially similar structure as locking pin assembly 800, with sleeves 8103, and 8203 in FIG. 13 replacing cylindrical sheath 804 in FIG. 8, and double beveled sheath 8101 (see e.g., FIG. 13, 14A) as well as double beveled mushroom sheath 852 (see e.g., FIG. 15) replacing extender 403, 404, 803 (see e.g., FIGS. 4A, 4B, 8A, 8B).

Figure 14A:
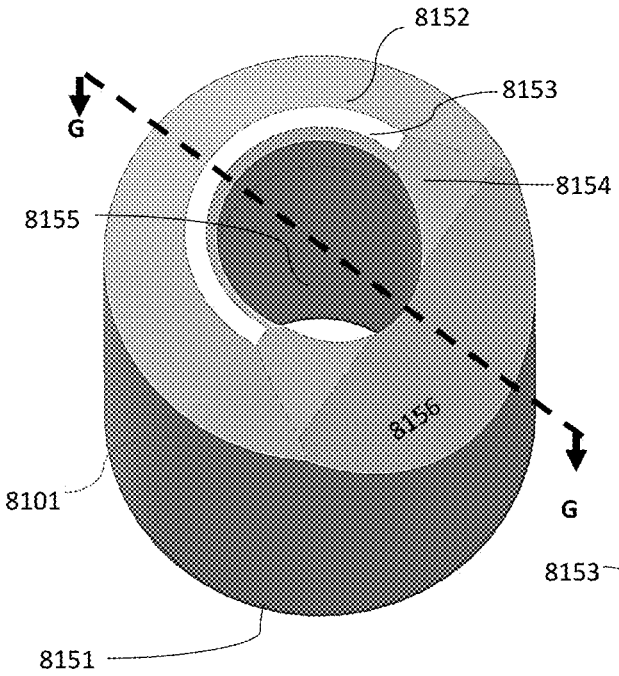
FIG. 14A illustrates an exemplary implementation of a double-beveled barrel pin sheath used with the anti-bumping pin assemblies disclosed, with FIG. 14B being a Y-Z cross section of the double-beveled barrel pin sheath illustrated in FIG. 14A, taken along line G-G.
Figure 14B:
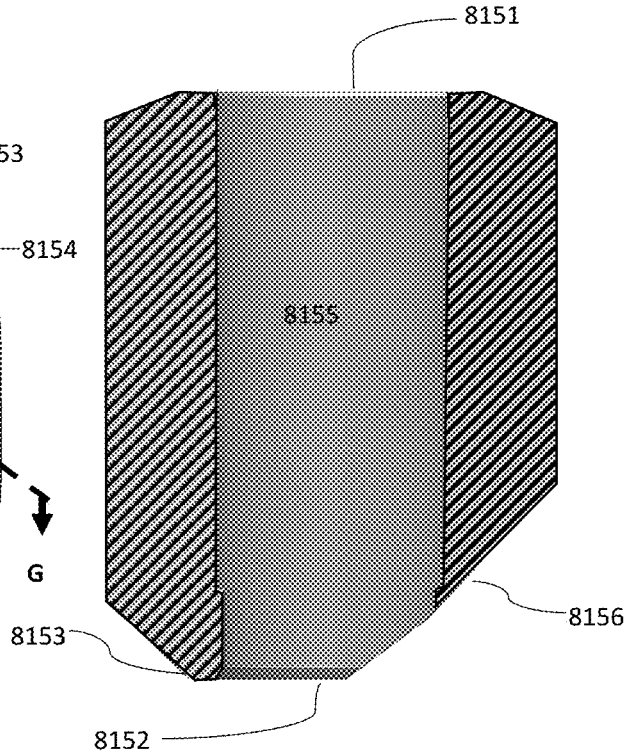
Figure 15:
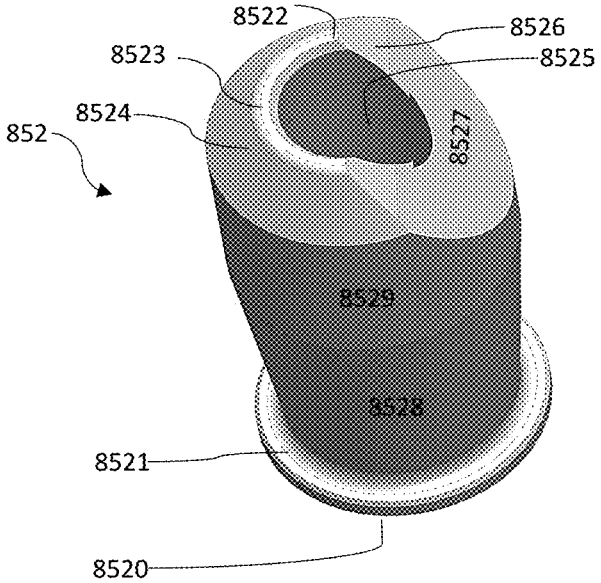
FIG. 15, illustrates double beveled mushroom sheath for an exemplary implementation of an anti-bumping locking pin.

As illustrated in conjunction with FIGS. 13-15 and in an exemplary implementation, key blade 900 (see e.g., FIGS. 9A-10A, elongated key blade 900, elongated key blade 900 being substantially flat with a proximal end 901 and a distal end 902 having depression 904*i*, and having first surface 9010 and symmetric second surface 9011 defining longitudinal axis ($X_L$, see e.g., FIG. 1A), wherein each $i^{th}$ depression 904*i*, being generally, concave (but not necessarily) can be configured to have a unique topology 9040, and be convex in certain exemplary implementations, with the depression walls forming a unique arcuate slope 9041, sized and configured to be complimentary to at least one of bevels 8156, and 8527 of double beveled sheath 8101 (see e.g., FIG. 13, 14A) as well as double beveled mushroom sheath 852 (see e.g., FIG. 15). As further illustrated, double beveled sheath 8101 (see e.g., FIG. 13, 14A) as well as double beveled mushroom sheath 852 (see e.g., FIG. 15) defining two different slopes 8154, 8156, 8526, 8527 respectively cut along a predefined section of the perimeter 8529 (see e.g., FIG. 15). Double beveled (cylindrical, although not necessarily) sheath 8101 further defining through shaft 8155, and comprises apical end 8151 and basal end 8152, having surface 8153 that is complimentary to unique topology 9040, with double bevels 8156, and 8154. Similar to locking pin assembly, doubled beveled sheath 8101 is coaxial with barrel pin 802 both abutting sleeves 8103, and 8203 in FIG. 13 with column pins 8104, 8204 having similar configuration for forming the necessary shea-line for rotating barrel 210 in cylindrical housing 201.

As indicated, key blade 900 with flared punchings, or depressions 904*i*, which, following insertion of key blade 900 in keyway 205, abut against barrel pins assemblies 8101, 8102 and 8101, 8202 (see e.g., FIG. 13) or 802, 852 (see e.g., FIG. 5) housed in cylinder lock 200. The depth, position, topology 9040 and slopes 9041 of depressions 904*i* constitute the cuts of the key that corresponds to the position of barrel pins assemblies 8101, 8102 and 8101, 8202 (see e.g., FIG. 13) or 802, 852 (see e.g., FIG. 5) adapted to allow the rotation of barrel 205.

To reiterate, preparing a "bumping key" comprises provided with punchings having the maximum depth obtainable in the thickness of the key itself. The bumping key can be inserted in the keyway of the lock at a length greater than the key blade 900. In general, the bumping key is made by providing thereon maximum-depth depressions. By inserting the bumping key in the keyway, all the barrel pins arrange at their maximum height. By hitting the key to push it further into the keyway, the pistons are subjected to an impact in a radial direction, making the rotation of the rotor possible. However, using the anti-bumping pin assemblies disclosed herein, the presence of barrel pins assemblies 8101, 8102 and 8101, 8202 (see e.g., FIG. 13) or 802, 852 (see e.g., FIG. 5), due to the deepest cuts possible with the key blade sought to be used as a bumping key, the slopes 9401, of depressions 904*i* will ostensibly change such that freely rotating double beveled sheath 8101 and double beveled mushroom sheath 852 will distort the alignment of barrel pins 802, 8102, 8202, thus preventing the unauthorized opening of the lock.

In an exemplary implementation, the locking pin assembly, incorporated in cylinder lock 200, operable to transition between a locked position where at least one of: basal end 8012 of column pin 801, basal end 8041 of cylindrical sheath 804, apical end 8022 of barrel pin 802, and apical end 8038 of cylindrical hinging member 8031—are not coplanar (see e.g., FIG. 6A, and an open position where basal end 8012 of column pin 801, nested within cylindrical sheath 804 (configured to telescopically move therein) and while being coplanar (in other words, substantially all points on both elements portions exist on a single geometric continuous plane) with basal end 8041 thereof, are abutting apical end 8022 of barrel pin 802 nested (and configured to telescopically move therein) within cylindrical hinging member 8031 and being coplanar with apical end 8038 thereof, is used to implement the methods disclosed.

Accordingly, provided herein is a method of preventing an unauthorized entry to an enclosed space having an opening with a door having cylinder lock 200 therein by key bumping, cylinder lock 200 configured to transition between locked position preventing entry to enclosed space, and an open position allowing entry to enclosed space, the method comprises: providing a door (not shown) wherein cylinder lock 200 comprises: rotatable barrel 210 defining external surface 211, having proximal 212 end and distal end 213 with an axial keyway 205 and plurality of barrel bores 215*k* extending radially from, and in communication with axial keyway 205, barrel 210 being selectably, rotatably movable within cylindrical housing portion 201; cylindrical housing portion 201 having column portion 202 with plurality of column bores 203*j* in registration with plurality of column bores 215*k*, extending radially from cylindrical housing portion 201, wherein one $j^{th}$ column bore 203*j* and at least one $k^{th}$ barrel bore 215*k* in registration with that $j^{th}$ column bore 203*j*, both—in combination comprise locking pin assembly 800, wherein locking pin assembly 800 comprises barrel pin assembly disposed within $k^{th}$ barrel bore 215*k*, barrel pin assembly comprising barrel pin 802 having predetermined length with apical end 8022 and distal end 8021, barrel pin 802 defining longitudinal axis $X_{L802}$; and extender 403, 404, 803 (see e.g., FIGS. 4A, 4B, 8A, 8B), having an apical end 8038, slidably, coupled to barrel pin 802, operable to slidably translate along barrel pin 802 in parallel with barrel pin's longitudinal axis $X_{L802}$; column pin assembly disposed within $j^{th}$ column bore 203*j*, column pin assembly comprising: cylindrical sheath 804 having an apical end 8040, basal end 8041, internal diameter $D_6$ and external diameter $D_5$; and column pin 801 having flanged, frustoconical apical end 8011 and basal end 8012, column pin 801 being nested in and concentric with cylindrical sheath 804, column pin 801 being slidably coupled to cylindrical sheath 804; stopper 806 engaged within $j^{th}$ column bore 203*j*; and biaser 805, (interchangeable with biasing element, or compression spring) disposed in $j^{th}$ column bore 203*j* beneath stopper 806 and coupled to column pin 801, operable to bias column pin 801 away from stopper 806 toward axial keyway 205.

The term "about", when used in the description of the technology and/or claims means that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art. In general, an amount, size, formulation, parameter or other quantity or characteristic is "about" or "approximate" whether or not expressly stated to be such and may include the end points of any range provided including, for example ±25%, or ±20%, specifically, ±15%, or ±10%, more specifically, ±5% of the indicated value of the disclosed amounts, sizes, formulations, parameters, and other quantities and characteristics.

All ranges disclosed herein are inclusive of the endpoints, and the endpoints are independently combinable with each other. "Combination" is inclusive of blends, mixtures, alloys, reaction products, and the like. Furthermore, the terms "first," "second," and the like, herein do not denote any order, quantity, or importance, but rather are used to denote one element from another. The terms "a", "an" and "the" herein do not denote a limitation of quantity, and are to be construed to cover both the singular and the plural, unless otherwise indicated herein or clearly contradicted by context. The suffix "(s)" as used herein is intended to include both the singular and the plural of the term that it modifies, thereby including one or more of that term (e.g., the bore(s) includes one or more bore). Reference throughout the specification to "one exemplary implementation", "another exemplary implementation", "an exemplary implementation", and so forth, means that a particular element (e.g., feature, structure, and/or characteristic) described in connection with the exemplary implementation is included in at least one exemplary implementation described herein, and may or may not be present in other exemplary implementations. In addition, it is to be understood that the described elements may be combined in any suitable manner in the various exemplary implementations.

As used herein, the language referring in certain exemplary implementations to "sized, shaped and configured" refer to complimentary surfaces that facilitate the interaction indicated, for example, engaging the basal end 8033 of engagement member 8031 in extender 803 on complimentary surface 1040 (or 1041, 1042 for basal ends 4033, 4043, see e.g., FIGS. 4A, 4B).

While particular exemplary implementations have been described, alternatives, modifications, variations, improvements, and substantial equivalents that are or may be presently unforeseen may arise to applicants or others skilled in the art. Accordingly, the appended claims as filed and as they may be amended, are intended to embrace all such alternatives, modifications variations, improvements, and substantial equivalents.

What is claimed:

1. A locking pin assembly comprising:

a) a barrel pin assembly comprising i. a barrel pin having a predetermined length with an apical end and a basal end, the barrel pin defining a longitudinal axis; and ii. an extender, having an apical end, slidably, coupled to the barrel pin, operable to slidably translate along the barrel pin in parallel with the barrel pin's longitudinal axis b) a column pin assembly comprising:

i. a cylindrical sheath having an apical end, a basal end, an internal diameter and an external diameter; and ii. a column pin having an apical end and a basal end, the column pin being nested in and concentric with the cylindrical sheath, the column pin being slidably coupled to the cylindrical sheath;

c) a stopper; and d) a biaser disposed beneath the stopper and coupled to the column pin, operable to bias the column pin away from the stopper.

2. The locking pin assembly of claim 1, wherein the extender is comprised of:

a) a cylindrical hinging member having an apical end, a basal end, defining an external diameter and an internal diameter, the internal diameter configured to accommodate the barrel pin, wherein the cylindrical hinging member sized and configured to cover a portion of the barrel pin that is shorter than the length of the barrel pin;

b) a linker, radially coupled to the cylindrical hinging member at the basal end of the cylindrical hinging member; and c) an engagement member, having an apical end and a beveled basal end, wherein the beveled basal end defines a predetermined surface topology, wherein the linker and the engagement member define a predetermined perimeter shape.

3. The locking pin assembly of claim 2, wherein the column pin is a cylindrical rod, defining a top portion having a first diameter and length, a mid-portion having a second diameter and length and a basal portion having a third diameter and length.

4. The locking pin assembly of claim 3, wherein:

a) the biaser is a cylindrical spring having an apical end and a basal end, both defining an end diameter, with a mid-portion defining a mid-diameter;

b) the end diameter of the spring is larger than the first diameter of the top portion column pin and smaller than the second diameter; and c) the internal diameter of the cylindrical sheath is larger than the mid-portion diameter of the spring.

5. The locking pin assembly of claim 4, wherein:

a) the barrel pin is a cylindrical rod and wherein the apical end defines a diameter that is identical to the third diameter of the basal portion of the column pin b) the external and internal diameter of the cylindrical sheath are each identical to the respective external and internal diameters of the cylindrical hinging member of the extender.

6. The locking pin assembly of claim 5, operable to transition between:

a) an opening configuration, whereby the basal end of the column pin, nested within the cylindrical sheath and being coplanar with the basal end thereof are abutting the apical end of the barrel pin nested within the cylindrical hinging member and being coplanar with the apical end thereof; and b) a locking configuration, whereby at least one of: the basal end of the column pin, the basal end of the cylindrical sheath, the apical end of the barrel pin, and the apical end of the cylindrical hinging member—are not coplanar.

7. The locking pin assembly of claim 1, wherein the extender is a double beveled sheath defining two different slopes cut into the extender along a predefined section of the extender perimeter.

8. The key of claim 7, wherein the longitudinal axis defined by the key blade and the longitudinal axis defined by the elongated engagement area form a predefined angle.

9. The key of claim 8, wherein the depression is concave and wherein the lowest point in the depression is convex with a surface that is complimentary to the surface of the basal end of the barrel pin.

10. The key of claim 9, wherein the depression is sized to have a predetermined arcuate slope.

11. A key comprising a key blade for use with the locking pin assembly of claim 1, defining at least one planar surface with a longitudinal axis, the key blade defining:

a) at least one depression, operable to reversibly engage the basal end of the barrel pin; and b) an elongated engagement area abutting the at least one depression, the elongated engagement area defining a longitudinal axis and having a complementary surface to the predetermined surface topology of the engagement member of the extender.

12. The key of claim 11, wherein the predetermined angle is between about 15° and 165°.

13. A cylinder lock comprising:

a) a rotatable barrel defining an external surface, having a proximal end and a distal end with an axial keyway and a plurality of barrel bores extending radially from, and in communication with the keyway, the barrel being selectably, rotatably movable within a cylindrical housing portion;

b) the cylindrical housing portion having a column portion with a plurality of column bores in registration with the plurality of barrel bores, extending radially from the cylindrical housing portion, wherein at least one column bore and at least one barrel bore in registration therewith, in combination, comprise the locking pin assembly of claim 1.

14. The cylinder lock of claim 13, wherein the at least one column bore and at least one barrel bore in registration therewith is configured such that:

a) the column bore comprises the column pin assembly; and b) the barrel bore in registration therewith, comprises the barrel pin assembly.

15. The cylinder lock of claim 14, wherein the registered barrel bore further defines a cavity sized and configured to accommodate the linker and the engagement member of the extender, sized and configured to allow the cylindrical hinging member to slidably translate along the barrel pin.

16. A key assembly comprising:

a) an elongated key blade, the elongated key blade being substantially flat and having a first surface and a symmetric second surface defining a longitudinal axis;

b) an ovoid depression defined on the first surface with a major axis and a minor axis, having side walls and a floor, wherein the major axis of the ovoid depression extends from the center of the elongated key blade—transverse to the longitudinal axis of the elongated key blade;

c) an through aperture, defined in the ovoid depression spanning the width of the elongated key blade, the through aperture having a diameter smaller than the minor axis of the ovoid depression and is bored in the center of the key blade, wherein the floor of the ovoid depression form a shelf extending radially to the aperture;

d) an ovoid male cap accommodated in the depression comprising:

i. an outer surface and an inner surface;

ii. a double flanged cylindrical fitting having an internal diameter extending inward from the inner surface, the fitting having a basal resilient interrupted flange, operable to frictionally engage a portion of an ovoid female base;

e) the ovoid female base accommodated in the depression comprising:

i. an outer surface identical to the outer surface of the ovoid male cap, and an inner surface;

ii. a cylindrical well defined in the inner surface;

iii. an annulus extending inward on the periphery of the cylindrical well, the annulus having an outer diameter sized to abut the minor axis of the ovoid depression, and be larger than the through aperture, the annulus defining an internal rim operable to engage the basal resilient interrupted flange of the ovoid male cap; and f) a first biasing element, disposed within the double flanged cylindrical fitting and abutting the inner surface at the cylindrical well of the ovoid female base and is operable to bias the ovoid male cap from the ovoid female base, wherein the outer surface of the ovoid male cap defines at least two different topologies.

17. The key assembly of claim 16, wherein the major axis of the ovoid depression extends from the center of the elongated key blade—transverse to the longitudinal axis of the elongated key blade at a predetermined angle of between 0° and about 90° off normal.

18. The key assembly of claim 16, wherein the outer surface of the ovoid male cap defines a first and a second topologies, whereby the ovoid female base defines matching topologies, the first topology being coaxial with the through aperture and the second topology defined along the major axis of the ovoid depression at a distance greater than the minor axis of the ovoid depression, wherein:

a) the second topology is configured to engage a barrel locking pin having a basal end with a complimentary surface to the second topology; and b) the first topology, is configured to engage an extender operably coupled to the barrel locking pin, wherein the extender comprises a basal end with a complimentary surface to the first topology.

19. The key assembly of claim 18, wherein the barrel locking pin is a locking pin assembly comprising: a barrel pin assembly comprising: a barrel pin having a predetermined length with an apical end and a basal end, the barrel pin defining a longitudinal axis; and an extender, having an apical end, slidably, coupled to the barrel pin, operable to slidably translate along the barrel pin in parallel with the barrel pin's longitudinal axis; a column pin assembly comprising: a cylindrical sheath having an apical end, a basal end, an internal diameter and an external diameter; and a column pin having an apical end and a basal end, the column pin being nested in and concentric with the cylindrical sheath, the column pin being slidably coupled to the cylindrical sheath; a stopper; and a biaser disposed beneath the stopper and coupled to the column pin, operable to bias the column pin away from the stopper.

20. The key assembly of claim 18, further comprising:

a) in the ovoid male cap:

i. a first circular opening being coaxial with the double flanged cylindrical fitting;

ii. a first ring disposed on the outer surface of the ovoid male cap, the first ring being coaxial with the first circular opening and having an internal diameter smaller than the internal diameter of the double flanged cylindrical fitting; and iii. a first ball bearing, sized and configures to partially extend from the outer surface outward from the first ring, the first ball bearing being biased outward by the first biasing element; and b) in the ovoid female base:

i. a first circular opening being coaxial with and extending into the cylindrical well;

ii. a first ring disposed on the outer surface of the ovoid female base, the first ring being coaxial with the first circular opening and having an internal diameter smaller than a second ball bearing, said second ball bearing being identical to the first ball bearing; and;

iii. the second ball bearing, sized and configures to partially extend from the outer surface of the ovoid female base outward from the first ring, the second ball bearing being biased outward by the first biasing element.

21. The key assembly of claim 20, further comprising:

a) in the ovoid male cap:

i. a second circular opening defined in the outer surface along the major axis of the ovoid depression at a distance greater than the minor axis of the ovoid depression;

ii. a second ring disposed on the outer surface of the ovoid male cap, the second ring being coaxial with the second circular opening and having an internal diameter smaller than a third ball bearing;

iii. the third ball bearing, sized and configures to partially extend from the outer surface of the ovoid male cap outward from the second ring, the third ball bearing being biased outward by a second biasing element; and iv. the second biasing element, disposed between the shelf formed by the floor of the ovoid depression and the third ball bearing; and b) in the ovoid female base:

i. a second circular opening defined in the outer surface along the major axis of the ovoid depression at a distance greater than the minor axis of the ovoid depression;

ii. a second ring disposed on the outer surface of the ovoid female base, the second ring being coaxial with the second circular opening and having an internal diameter smaller than a fourth ball bearing;

iii. the fourth ball bearing, sized and configures to partially extend from the outer surface of the ovoid female base outward from the second ring, the fourth ball bearing being biased outward by a third biasing element; and iv. the third biasing element, disposed between the shelf formed by the floor of the ovoid depression and the fourth ball bearing.

22. A key and lock combination comprising a) a key assembly comprising:

i. an elongated key blade, the elongated key blade being substantially flat and having a first surface and a symmetric second surface defining a longitudinal axis;

ii. an ovoid depression defined on the first surface with a major axis and a minor axis, having side walls and a floor, wherein the major axis of the ovoid depression extends from the center of the elongated key blade—transverse to the longitudinal axis of the elongated key blade;

iii. an through aperture, defined in the ovoid depression spanning the width of the elongated key blade, the through aperture having a diameter smaller than the minor axis of the ovoid depression and is bored in the center of the key blade, wherein the floor of the ovoid depression form a shelf extending radially to the aperture;

iv. an ovoid male cap accommodated in the depression comprising:

an outer surface and an inner surface;

a double flanged cylindrical fitting having an internal diameter extending inward from the inner surface, the fitting having a basal resilient interrupted flange, operable to frictionally engage a portion of an ovoid female base;

v. the ovoid female base accommodated in the depression comprising:

an outer surface identical to the outer surface of the ovoid male cap, and an inner surface;

a cylindrical well defined in the inner surface;

an annulus extending inward on the periphery of the cylindrical well, the annulus having an outer diameter sized to abut the minor axis of the ovoid depression, and be larger than the through aperture, the annulus defining an internal rim operable to engage the basal resilient interrupted flange of the ovoid male cap; and a first biasing element, disposed within the double flanged cylindrical fitting and abutting the inner surface at the cylindrical well of the ovoid female base and is operable to bias the ovoid male cap from the ovoid female base, wherein the outer surface of the ovoid male cap defines at least two different topologies:

at least partially inserted in b) an axial key way of a cylinder lock comprising:

i. a rotatable barrel defining an external surface having a proximal end and a distal end with an axial keyway and a plurality of barrel bores extending radially from, and in communication with the keyway, the barrel being selectably, rotatably movable within a cylindrical housing portion;

ii. the cylindrical housing portion having a column portion with a plurality of column bores in registration with the plurality of barrel bores, extending radially from the cylindrical housing portion, wherein at least one column bore and at least one barrel bore in registration therewith, in combinations comprise a locking pin assembly having a barrel pin assembly comprising: a barrel pin having a predetermined length with an apical end and a basal end, the barrel pin defining a longitudinal axis; and an extender, having an apical end, slidably, coupled to the barrel pin, operable to slidably translate along the barrel pin in parallel with the barrel pin's longitudinal axis: a column pin assembly comprising: a cylindrical sheath having an apical end, a basal end, an internal diameter and an external diameter; and a column pin having an apical end and a basal end, the column being, nested in and concentric with the cylindrical sheath, the column pin being slidably coupled to the cylindrical sheath; a stopper; and a biaser disposed beneath the stopper and coupled to the column pin, operable to bias the column pin away from the stopper.

23. A method of preventing an unauthorized entry to an enclosed space having an opening with a door having a cylinder lock therein by key bumping, the cylinder lock configured to transition between a locked position preventing entry to the enclosed space, and an open position allowing entry to the enclosed space, the method comprises: providing a door wherein the cylinder lock comprises: a rotatable barrel defining an external surface, having a proximal end and a distal end with an axial keyway and a plurality of barrel bores extending radially from, and in communication with the keyway, the barrel being selectably, rotatably movable within a cylindrical housing portion; the cylindrical housing portion having a column portion with a plurality of column bores in registration with the plurality of column bores, extending radially from the cylindrical housing portion, wherein at least one column bore and barrel bore in registration therewith, both—in combination comprise a locking pin assembly, wherein the locking pin assembly comprises a barrel pin assembly disposed within the barrel bore, the barrel pin assembly comprising a barrel pin having a predetermined length with an apical end and a distal end, the barrel pin defining a longitudinal axis; and an extender, having an apical end, slidably, coupled to the barrel pin, operable to slidably translate along the barrel pin in parallel with the barrel pin's longitudinal axis; a column pin assembly disposed within the column bore, the column pin assembly comprising: a cylindrical sheath having an apical end, a basal end, an internal diameter and an external diameter; and a column pin having an apical end and a basal end, the column pin being nested in and concentric with the cylindrical sheath, the column pin being slidably coupled to the cylindrical sheath; a stopper engaged within the column bore; and a biaser disposed in the column bore beneath the stopper and coupled to the column pin, operable to bias the column pin and cylindrical sheath away from the stopper toward the axial keyway.

24. The method of claim 23, wherein the extender is comprised of:

a) a cylindrical hinging member having an apical end, a basal end, defining an external diameter and an internal diameter, the internal diameter configured to accommodate the barrel pin, wherein the cylindrical hinging member sized and configured to cover a portion of the barrel pin that is shorter than the length of the barrel pin;

b) a linker, radially coupled to the cylindrical hinging member at the basal end of the cylindrical hinging member; and c) an engagement member, having an apical end and a beveled basal end, wherein the beveled basal end defines a predetermined surface topology, wherein the linker and the engagement member define a predetermined perimeter shape.

25. The method of claim 24, wherein the barrel bore in registration with the column bore, further defines a cavity operable to accommodate the linker and the engagement member of the extender, sized and configured to allow the cylindrical hinging member to slidably translate along the barrel pin.

26. The method of claim 25, wherein the locking pin assembly is operable to transition between:

a) an opening configuration, whereby the basal end of the column pin, nested within the cylindrical sheath and being coplanar with the basal end thereof, are abutting the apical end of the barrel pin nested within the cylindrical hinging member and being coplanar with the apical end thereof and the external surface of the barrel; and b) a locking configuration, whereby at least one of: the apical end of the barrel pin, the apical end of the cylindrical hinging member, and the external surface of the barrel—are not coplanar.

27. The method of claim 23, wherein at least one column bore and barrel bore in registration therewith, both—in combination further comprise an anti-bumping pin assembly, wherein the anti-bumping pin assembly comprises a barrel pin assembly disposed within the barrel bore, the barrel pin assembly comprising a barrel pin having a predetermined length with an apical end and a distal end, the barrel pin defining a longitudinal axis; and a double beveled sheath, having an apical end, slidably, coupled to the barrel pin, operable to slidably translate along the barrel pin in parallel with the barrel pin's longitudinal axis; a column pin assembly disposed within the column bore, the column pin assembly comprising: a column sleeve having an apical end, a basal end, an internal diameter and an external diameter; and a column pin having an apical end and a basal end, the column pin being nested in and concentric with the cylindrical sheath, the column pin being slidably coupled to the cylindrical sheath; a stopper engaged within the column bore; and a biaser disposed in the column bore beneath the stopper and coupled to the column pin, operable to bias the column pin and cylindrical sheath away from the stopper toward the axial keyway.

28. The method of claim 27, wherein at least one slop of one of the bevels in the double beveled sheath is complimentary to a depression slope defined in a key assembly operable to transition the cylinder lock between a locked position preventing entry to the enclosed space, and an open position allowing entry to the enclosed space.

* * * * *